US011110320B2

(12) United States Patent
Bono

(10) Patent No.: US 11,110,320 B2
(45) Date of Patent: Sep. 7, 2021

(54) SWIMMING CAPS

(71) Applicant: Leslie Theresa Bono, Lititz, PA (US)

(72) Inventor: Leslie Theresa Bono, Lititz, PA (US)

(73) Assignee: Leslie Theresa Bono, Lititz, PA (US)

( * ) Notice: Subject to any disclaimer, the term of this patent is extended or adjusted under 35 U.S.C. 154(b) by 0 days.

(21) Appl. No.: 14/407,536

(22) PCT Filed: Jun. 13, 2013

(86) PCT No.: PCT/GB2013/000260
§ 371 (c)(1),
(2) Date: Dec. 12, 2014

(87) PCT Pub. No.: WO2013/186514
PCT Pub. Date: Dec. 19, 2013

(65) Prior Publication Data

US 2015/0135392 A1 May 21, 2015

(30) Foreign Application Priority Data

Jun. 14, 2012 (GB) ..... 1210543

(51) Int. Cl.
*A63B 33/00* (2006.01)
*A42B 1/22* (2006.01)
*A42B 1/12* (2006.01)

(52) U.S. Cl.
CPC ..... *A63B 33/00* (2013.01); *A42B 1/12* (2013.01); *A42B 1/225* (2013.01)

(58) Field of Classification Search
CPC . A45D 8/34; A45D 19/18; A45D 8/36; A45D 8/40; A45D 2008/004; A45D 8/00; A45D 8/14; A42C 5/04; A42C 5/02; Y10S 2/11; Y10S 2/918; A41D 20/00; A42B 1/225; A42B 1/12; A42B 1/22; A42B 1/004; A42B 1/041; A42B 7/00; A63B 33/00; A63B 71/10
See application file for complete search history.

(56) References Cited

U.S. PATENT DOCUMENTS 2,063,232 A * 12/1936 Winnifred ..... A42B 1/12 2/68
2,447,708 A * 8/1948 McCaffrey ..... A42B 1/12 2/68
2,651,310 A 9/1953 Selson
(Continued)

FOREIGN PATENT DOCUMENTS

GB 2095989 10/1982
GB 2335135 A 9/1999
(Continued)

OTHER PUBLICATIONS

Wolter, Antje "Swim Cap Fashion Glam." Available at https://www.notjustalabel.com/editorial/swim-cap-fashion-glam as of May 6, 2011.*

(Continued)

*Primary Examiner* — Joshua T Kennedy
(74) *Attorney, Agent, or Firm* — Nixon & Vanderhye PC

(57) ABSTRACT

A swimming cap made of a synthetic rubber and sized to substantially cover the scalp of a wearer's head, the cap having an opening formed in a posterior region thereof such that the wearer's hair can pass through the opening to form a ponytail.

6 Claims, 3 Drawing Sheets

(56) References Cited

U.S. PATENT DOCUMENTS 2,753,566 A * 7/1956 Perelman ..... A42B 1/206 2/171.5
2,864,383 A * 12/1958 Jacks ..... A45D 8/34 132/273
3,038,376 A * 6/1962 Kancepolsky ..... G02C 3/003 351/157
3,041,628 A * 7/1962 Fish ..... A42B 1/208 2/195.2
3,052,888 A * 9/1962 Blanchard ..... A42B 1/12 2/68
3,357,070 A * 12/1967 Soloan ..... A45D 8/34 132/273
3,407,408 A * 10/1968 Hansen ..... A42B 1/12 2/68
3,710,393 A * 1/1973 Douglas ..... A61F 9/02 128/201.23
3,782,396 A 1/1974 Tomlinson
3,996,621 A * 12/1976 Martienssen ..... A42B 1/12 2/68
4,267,850 A * 5/1981 Barrett ..... A45D 19/18 132/270
4,279,039 A * 7/1981 Drew ..... A42B 1/12 2/428
4,998,544 A * 3/1991 Obergfell ..... A45D 8/36 132/212
5,046,200 A * 9/1991 Feder ..... A61F 9/027 128/207.11
5,170,509 A * 12/1992 Leopold ..... A41G 5/0093 132/273
5,239,705 A * 8/1993 Leopold ..... A41G 5/0093 132/273
D343,283 S * 1/1994 Sommers ..... D2/867
5,301,696 A * 4/1994 Revson ..... A45D 8/34 132/273
5,321,854 A * 6/1994 Kronenberger ..... A42B 1/225 2/195.1
5,359,733 A * 11/1994 Brannon ..... A42B 1/248 2/195.1
5,499,638 A * 3/1996 Ripley ..... A45D 8/36 132/246
5,546,603 A * 8/1996 Lawhorne ..... A41D 20/00 2/171
5,555,571 A * 9/1996 McCaffrey ..... B63C 11/12 2/428
5,615,414 A * 4/1997 Landis ..... A42B 1/22 2/12
5,644,799 A * 7/1997 Armenta ..... A42B 1/225 132/273
5,787,904 A * 8/1998 Michaud ..... A45D 8/34 132/128
5,855,026 A * 1/1999 Viola ..... A42B 1/12 2/428
5,875,488 A * 3/1999 Milani ..... A42B 1/225 2/12
5,875,494 A * 3/1999 Garnier, Jr. ..... A42B 1/225 2/171.5
5,933,872 A * 8/1999 Lema ..... A42B 1/225 2/209.3
6,076,532 A * 6/2000 Thomas ..... A45D 8/36 132/273
6,401,255 B1 * 6/2002 Douglas ..... A42B 1/225 2/207
6,428,167 B1 * 8/2002 Leonardi ..... A61F 9/027 132/273
6,647,553 B2 * 11/2003 Hoyez ..... A42C 5/04 2/195.1
6,711,749 B2 * 3/2004 White ..... A42B 1/225 2/195.8
6,738,986 B1 * 5/2004 Martin ..... A42B 1/241 2/171
7,047,571 B1 5/2006 Kelly
7,174,901 B2 * 2/2007 Haar ..... A45D 8/36 132/273
7,293,566 B2 * 11/2007 Thall ..... A45D 8/40 132/274
7,665,154 B2 * 2/2010 Gerstel Costello .... A42B 1/225 2/171
7,945,971 B2 * 5/2011 Garza ..... A42B 1/225 2/209.3
8,141,395 B2 * 3/2012 Dillavou ..... D04B 7/08 66/171
8,214,928 B1 * 7/2012 Cleveland ..... A42B 1/22 2/410
8,769,719 B2 * 7/2014 Portas ..... A42B 1/12 2/68
2002/0162155 A1 11/2002 Griffen
2003/0009813 A1 * 1/2003 Dreher ..... A42B 1/225 2/171
2003/0135912 A1 * 7/2003 White ..... A42B 1/225 2/195.8
2003/0159707 A1 * 8/2003 Di Luca ..... A42B 1/041 132/270
2004/0006809 A1 * 1/2004 Crenshaw ..... A42C 5/04 2/209.3
2004/0163162 A1 * 8/2004 Benziger ..... A42B 1/08 2/411
2004/0244095 A1 * 12/2004 Sonne ..... A42B 1/067 2/175.4
2005/0061345 A1 * 3/2005 Srivastava ..... A45D 8/36 132/200
2005/0066421 A1 * 3/2005 Brundage ..... A42C 5/00 2/209.3
2005/0072440 A1 * 4/2005 Lee ..... A41G 5/0073 132/53
2005/0097655 A1 * 5/2005 Bascom ..... A42B 1/225 2/171
2005/0108810 A1 * 5/2005 Yan ..... A42B 1/062 2/195.4
2005/0268927 A1 * 12/2005 Alcala ..... A45D 8/34 132/53
2006/0032515 A1 * 2/2006 Thall ..... A45D 8/40 132/274
2006/0137706 A1 * 6/2006 Haar ..... A45D 8/36 132/273
2006/0168712 A1 * 8/2006 Mazzoccoli ..... A42B 1/08 2/411
2006/0191057 A1 * 8/2006 Lynn ..... A41G 5/0093 2/171
2006/0200889 A1 * 9/2006 Newman ..... A42B 1/12 2/68
2006/0206984 A1 * 9/2006 Jaye ..... A42B 1/225 2/209.3
2006/0277658 A1 * 12/2006 Marsh ..... A42B 1/064 2/171
2007/0094768 A1 * 5/2007 Moudgill ..... A42B 1/041 2/171
2007/0118970 A1 * 5/2007 Gerstel Costello .... A42B 1/225 2/195.2
2007/0250987 A1 * 11/2007 Adkins ..... A42B 1/225 2/209.3
2008/0209615 A1 * 9/2008 Raftery ..... A42B 1/225 2/209.13
2009/0038048 A1 * 2/2009 Thompson ..... A42B 1/12 2/68
2009/0139004 A1 * 6/2009 Vall ..... A42B 1/12 2/68
2009/0199323 A1 * 8/2009 Zakarian ..... A42B 1/225 2/209.14
2009/0255030 A1 * 10/2009 Guy ..... A42B 1/225 2/84
2010/0192273 A1 * 8/2010 Dodd ..... A63B 33/00 2/68
2011/0173739 A1 * 7/2011 Riesen ..... A42B 1/225 2/209.3
2012/0131717 A1 * 5/2012 Kaliner ..... A42B 1/241 2/68

(56) References Cited

U.S. PATENT DOCUMENTS

| | | | | |
|---|---|---|---|---|
| 2013/0000009 | A1* | 1/2013 | Portas | A42B 1/12 2/68 |
| 2013/0025026 | A1* | 1/2013 | Smith | A42B 1/225 2/209.3 |
| 2014/0109281 | A1* | 4/2014 | Waller | A42B 1/12 2/68 |
| 2014/0290682 | A1* | 10/2014 | Wendschuh | A45D 8/34 132/200 |
| 2015/0113706 | A1* | 4/2015 | Rogers | A42B 1/00 2/209.3 |
| 2015/0209621 | A1* | 7/2015 | Cason | A63B 33/00 2/68 |
| 2020/0008505 | A1* | 1/2020 | Ebrahim | A42B 3/28 |

FOREIGN PATENT DOCUMENTS

| | | | |
|---|---|---|---|
| JP | 2-264672 | A | 10/1990 |
| JP | 2010-141 | A | 1/2010 |
| WO | 01/37942 | A1 | 5/2001 |

OTHER PUBLICATIONS

Vogue's coverage of Miu Miu Fall 2008 Read-To-Wear Collection. Available at http://www.vogue.com/fashion-shows/fall-2008-ready-to-wear/miu-miu as of Mar. 1, 2008.*

Vogue's coverage of Miu Miu Fall 2008 Ready-To-Wear Collection. Photo #31 available at https://www.vogue.com/fashion-shows/fall-2008-ready-to-wear/miu-miu/slideshow/collection#31 as of Mar. 1, 2008.*

Antje Wolter, Signed Declaration of Statement(s), dated May 28, 2020.

Robert L. Rogers, General Affidavit "Pressure Measurements Due to Cap Stretch", dated Apr. 3, 2017.

Dr. Myfanwy Evans, "Research Into Skin That Holds Water", Freidrich Alexander University, dated Feb. 13, 2014.

"Unexpected Properties of Hair", L'OREALhair-science.com.

Baylor University Medical Center Proceedings, Nerve Diagram, Oct. 2004; 17(4): 418-419.

U.S. Appl. No. 11/362,345.

Facebook Comments, 4 pages.

"How to wear swim cap" diagram.

"Forehead Line" <img width="612" height="612" src="//cl.staticflickr.com/9/8112/8537999430_dfc46055f2_z.jpg" class="main-photo" alt="You can totally see where my swimming cap was! Stupid red line across my forehead . . . I by Cspokey">—7./ CspokeyBy:Cspokey.

International Swimming Hall of Fame, "The Ponytail Swim Cap" https://www.indiegogo.com/projects/the-ponytail-swimp-cap.

Examiner Letter issued in Application No. GB1210543.3 (dated Sep. 17, 2012 (four pages).

Search Report issued in Application No. GB1210543.3 (dated Sep. 14, 2012) (2 pages).

Dr. Alan Diamond, General Affidavit dated Apr. 3, 2017.

Reva O' Hallarn, "Did You Swim Today?", Dec. 6, 2020, https://www.facebook.com/groups/307563589265700/user/600709691, 27 pages.

* cited by examiner

SWIMMING CAPS

TECHNICAL FIELD

The present invention relates to swimming caps.

BACKGROUND

Swimming or bathing caps are commonly used by swimmers to both keep their hair out of their eyes whilst swimming and to keep their hair dry. Known caps are generally better at the former than at the latter, especially in the case of young children who will generally be able, one way or another, to get their hair wet.

Swimming caps are usually made of a plastic material having elastic properties such that the caps form a tight fit around the swimmer's head. Suitable materials include nylon-spandex blends, silicone, polyester, Neoprene and Latex.

Commercially available swimming caps tend to be utilitarian in design. They serve the purpose of covering the head and are very limited in terms of their design and aesthetic appearance. Manufacturers tend to differentiate their caps merely by colour and printed design. Of course, several variations of this generic swimming cap have been proposed and manufactured. For example, caps have been made which provide an internal pocket or space for accommodating longer hair. Such designs are not however aesthetically pleasing and do not appeal to a mass market. Another design, aimed primarily at keeping a swimmer's hair out of his or her eyes, has the appearance of a head band, or bandana, covering only the periphery of the swimmer's head. This design suffers from the disadvantage that it is difficult to keep in place, and will tend to slip in use, potentially covering the swimmer's eyes or otherwise becoming uncomfortable to wear.

Silicone and latex caps, designed to reduce drag and improve racing times, can be uncomfortably tight, difficult to put on, and are prone to falling off during swimming.

Existing spandex-lycra swimming caps, which are in contrast easy to take on and off, can result in unsightly and cumbersome bumps when hair is tucked in. These bumps may interfere with the straps of swimming goggles.

SUMMARY OF THE INVENTION

It is an object of the present to improve upon known swimming caps and in particular to provide a swimming cap which is both functional and attractive.

According to the present invention there is provided a swimming cap made of a synthetic rubber and sized to substantially cover the scalp of a wearer's head, the cap having an opening formed in a posterior region thereof such that the wearer's hair can pass through the opening to form a ponytail.

DETAILED DESCRIPTION

Particularly for swimmers with long hair, putting on and wearing a conventional swimming cap is difficult and uncomfortable. This can be particularly so for young children who are not very tolerant of having their hair twisted and pulled, and for lap swimmers who want to reduce cranial pressure caused by tight fitting caps. An improved swimming cap is proposed here which aim to solve these problems. This cap may be made of a conventional synthetic rubber, for example nylon, Latex, spandex-nylon blends, Neoprene, silicone rubber etc, but is provided with a hole at the back of the cap. The hole is sized and located such that a swimmer can pass his or her hair through the hole so that a "ponytail" hangs out of the back of the cap. The remainder of the swimmers head and hair remains covered by the cap. As well as being attractive, and offering an alternative to the existing generic swimming caps, the proposed design is extremely easy to put on as a swimmer can take hold of their hair, and put the cap on their head while passing the ponytail through the hole in the cap. The swimmer's hair does not get bunched up under the cap in this process.

Figure 1:
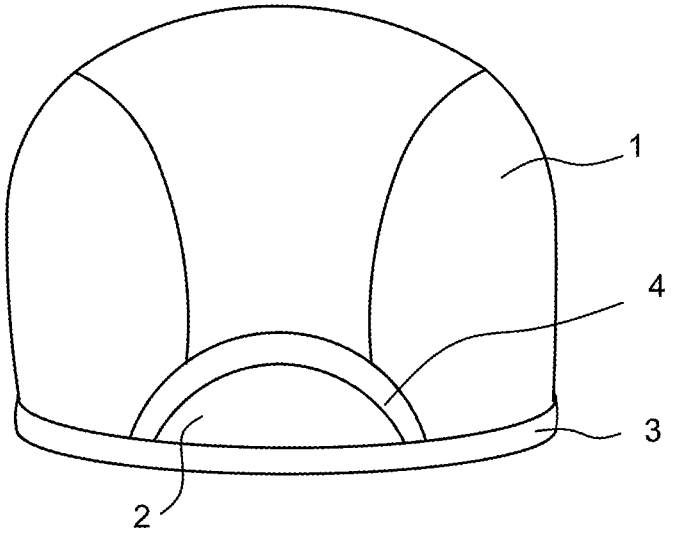
FIG. 1 is a rear view of a swimming cap.
Figure 2:
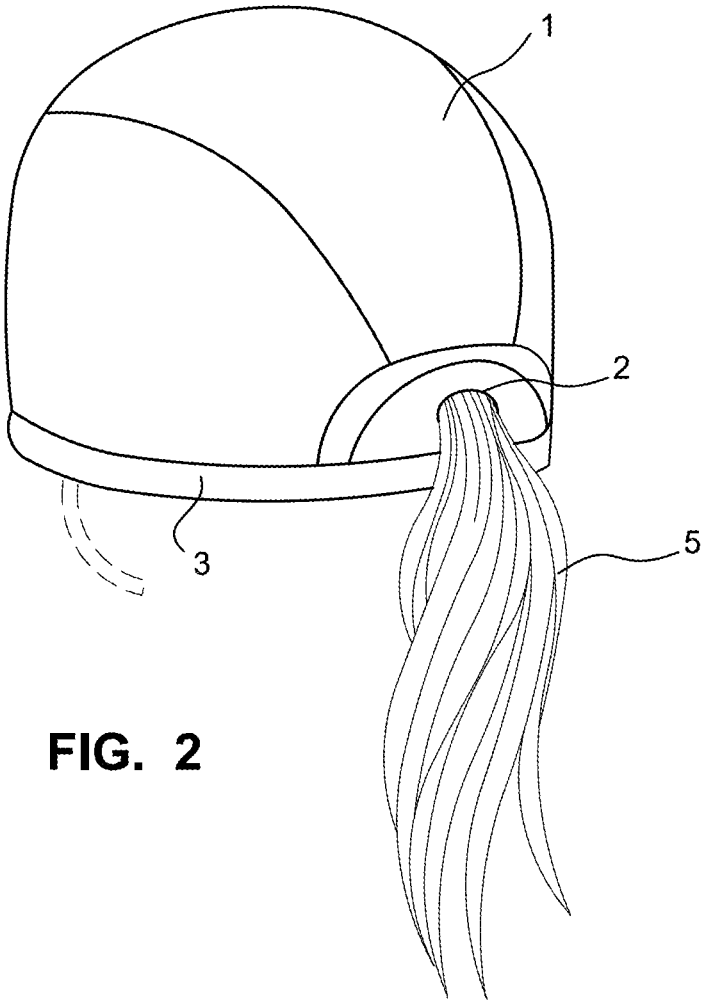
FIG. 2 is a side view of the cap of FIG. 1 with a ponytail shown projecting through the cap.

FIG. 1 illustrates a swimming cap having this design. The cap is indicated by the reference numeral 1, whilst the hole formed in the back of the cap is indicated by reference numeral 2. As with conventional caps, the outer periphery 3 of the cap is elasticized so as to form a tighter fit, to the swimmer's head, around the outer periphery. FIG. 2 in turn illustrates the cap 1 with a ponytail 5 projecting through the hole 2.

FIGS. 1 and 2 both illustrate an advantageous feature of the proposed design. This comprises an elasticized band 4 provided around the circumference of the opening in the cap 1. This feature will tend to pull the cap tight around the projecting ponytail, reducing the possibility for water to leak through the hole 2 and into the underside of the cap.

This band 4 may be formed in a number of ways. For example, it could be an integral part of the cap, formed during the molding of the cap such that the region around the opening tends to pull together around the opening. Alternatively, an elasticated band may be sewn, glued, or otherwise fixed around the opening, e.g. with a seam. Such a feature is known as "ruching". Rounded and or flat elastics may also be incorporated into the opening along with safety stitching.

Figure 3:
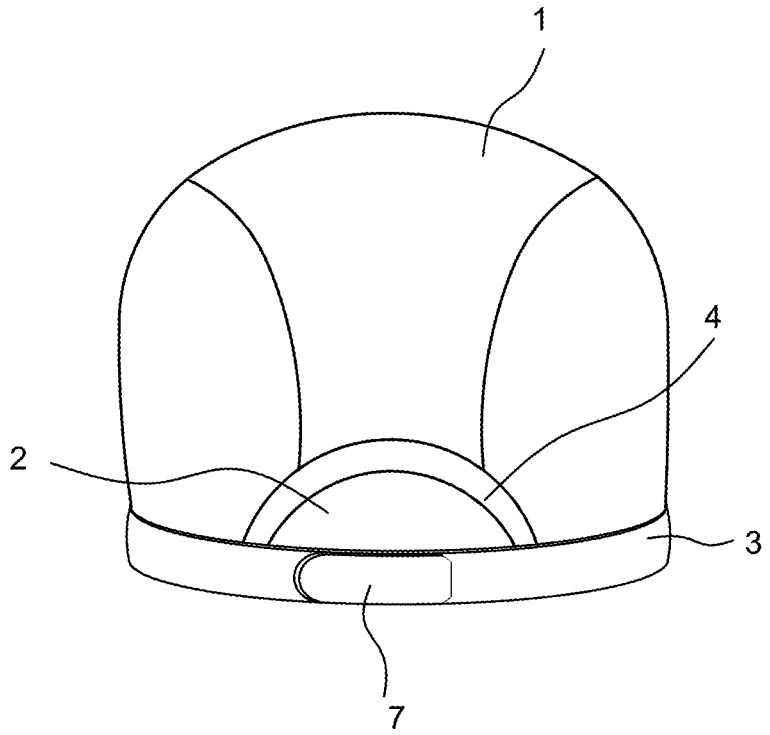
FIG. 3 is a rear view of an alternative embodiment of a swimming cap.

FIG. 3 illustrates a modified swimming cap design. In this design, the cap 5 is again provided with a hole 2. Provided in the region 7 beneath the opening 2 is an adjustment strap 8. This strap can be adjusted to vary the tightness of the bottom of the cap around the swimmer's head. The strap may comprise a Velcro® fastener 8 for easy use. Of course, other fasteners may be contemplated including buckles, press fasteners, soft snaps etc.

Figure 4:
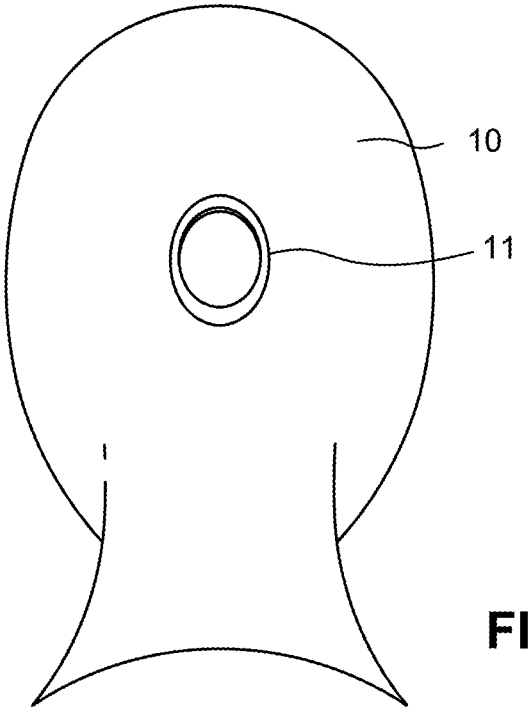
FIGS. 4 and 5 illustrate an alternative cap such as might be used for diving or snorkeling.
Figure 5:
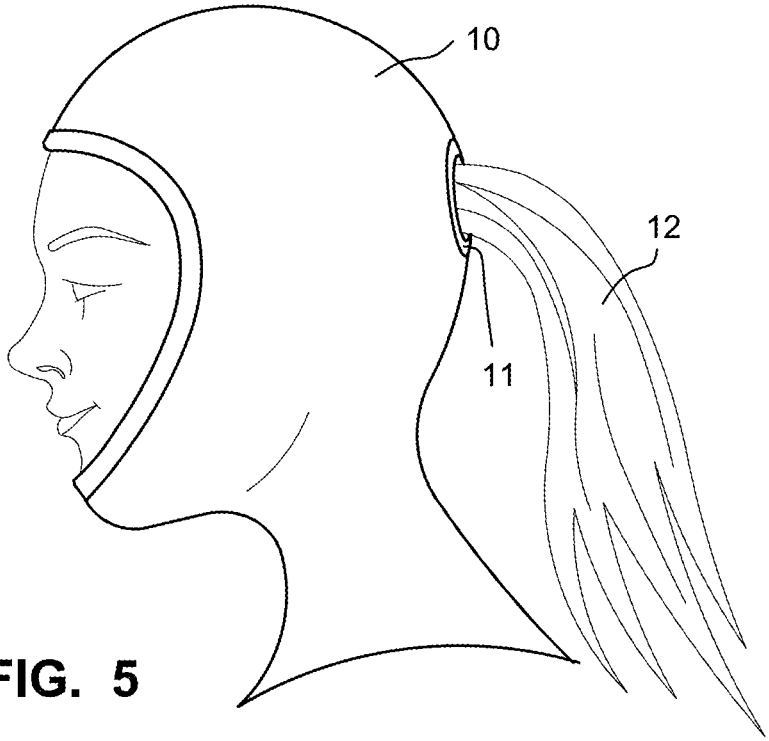

FIGS. 4 and 5 illustrate an alternative cap such as might be used for diving or snorkeling. The cap 10 is an all-over cap in so far as it covers the head and neck of the wearer, with a space at the front to allow the wearers face to show. Again, a hole 11 is provided at the back of the cap to allow the wearer's hair to be pulled through the hole, forming a ponytail 12.

It will be appreciated by the person of skill in the art that various modifications may be made to the above described embodiments without departing from the scope of the present invention.

The invention claimed is:

1. A swim cap consisting of a synthetic rubber dome comprising a front portion, a top portion, a lower peripheral edge, and a rear portion between the lower peripheral edge and the top portion, the lower peripheral edge when the dome is worn having an opening into an interior head space disposed within and enclosed by the dome, a center of the rear portion having a single hole through and completely surrounded b the synthetic rubber, the hole communicating the interior head space with the outside, the hole is provided with an elasticized band around a circumference of the hole and positioned in the rear portion between the lower peripheral edge and the top portion and configured to, when the cap is worn, allow passing and exiting of within the interior head space through the hole and permit the hair to egress out of the dome and form a ponytail that hangs outside of the swim cap to thereby in use alleviate at least some cranial pressure the swim cap would otherwise apply.

2. The swim cap of claim 1 wherein the synthetic rubber is selected from the group consisting of nylon-spandex blends, silicone, polyester, neoprene, and latex.

3. The swim cap of claim 1 further comprising an adjustment strap providing an adjustment to vary the tightness of the lower peripheral edge around the swimmer's head.

4. The swim cap of claim 3 wherein the strap comprises a fastener.

5. The swim cap of claim 1 wherein the dome is molded.

6. The swim cap of claim 1 wherein the hole has a circular shape.

* * * * *